United States Patent [19]

Suess et al.

[11] Patent Number: 5,073,301

[45] Date of Patent: Dec. 17, 1991

[54] PROCESS FOR STABILIZATION OF THE VISCOSITY OF WOOD PULPS

[75] Inventors: Hans U. Suess, Hasselroth, Fed. Rep. of Germany; Wilfried Eul, Ramsey, N.J.

[73] Assignee: Degussa Aktiengesellschaft, Frankfurt am Main, Fed. Rep. of Germany

[21] Appl. No.: 551,535

[22] Filed: Jul. 12, 1990

[30] Foreign Application Priority Data

Jul. 18, 1989 [DE] Fed. Rep. of Germany ..... 3923728

[51] Int. Cl.[5] ..... D21C 3/04

[52] U.S. Cl. ..... 252/402; 162/6; 162/7; 162/76; 162/89; 162/65

[58] Field of Search ..... 162/6, 7, 76, 65 B, 162/89; 252/402

[56] References Cited

U.S. PATENT DOCUMENTS

| | | | |
|---|---|---|---|
| 3,177,111 | 4/1965 | Larson | 252/188.2 |
| 3,193,445 | 7/1965 | Parker et al. | 162/76 |
| 3,308,012 | 3/1967 | Tobar | 162/76 |
| 3,720,577 | 3/1973 | Raymoulik | 162/76 |
| 3,725,194 | 4/1973 | Smith et al. | 162/76 |
| 3,769,152 | 10/1973 | Samuelson et al. | 162/76 |
| 4,016,029 | 4/1977 | Samuelson | 162/76 |
| 4,298,428 | 11/1981 | Breslin et al. | 162/72 |
| 4,372,811 | 2/1983 | Samuelson et al. | 162/72 |
| 4,372,812 | 2/1983 | Phillips et al. | 162/76 |
| 4,459,174 | 7/1984 | Papageorges et al. | 162/76 |
| 4,484,980 | 11/1984 | Allan | 162/72 |
| 4,487,656 | 12/1984 | Allan | 162/76 |
| 4,526,651 | 7/1985 | Allan | 162/76 |
| 4,626,319 | 2/1986 | Krueger et al. | 162/76 |
| 4,740,212 | 4/1988 | Yant et al. | 162/76 |

FOREIGN PATENT DOCUMENTS

| | | |
|---|---|---|
| 3308298 | 9/1984 | Fed. Rep. of Germany . |
| 0055607 | 5/1979 | Japan . |
| 821617 | 4/1981 | U.S.S.R. . |
| 0903429 | 2/1982 | U.S.S.R. . |
| 974073 | 11/1964 | United Kingdom . |

OTHER PUBLICATIONS

*Chemical Abstracts*, vol. 6, No. 99, Abstract No. 40030K, Kolar et al., "Chemical Reactions in Chlorine Dioxide Stages of Pulp Bleaching".

*Chemical Abstracts*, 95(18) Abstract No. 152388g, Kolar et al., The Reaction of Chlorine Dioxide with Lignin.

*Chemical Abstracts*, 103(4) Abstract No. 23943u, Vulcheva, E et al.

*Chemical Abstracts*, 82(14) Abstract No. 87939c, Sing et al.

Kordsachia, O., and R. Patt, "Full Bleaching of ASAM Pulps without Chlorine Compounds", *Holzforschung* (1988), vol. 42, pp. 203-209.

*Primary Examiner*—Deborah L. Kyle
*Assistant Examiner*—Valerie Fee
*Attorney, Agent, or Firm*—Beveridge, DeGrandi & Weilacher

[57] ABSTRACT

A process is described in which, by the addition of formamidinesulfinic acid in association with an ozone or ozone/oxygen treatment, the viscosity and strength of wood pulps are stabilized at the level that is obtained with use of conventional, chlorine-containing bleaching processes.

6 Claims, No Drawings

PROCESS FOR STABILIZATION OF THE VISCOSITY OF WOOD PULPS

BACKGROUND OF THE INVENTION

The present invention relates to a process for stabilization of the viscosity of wood pulps, that have been treated with ozone or ozone/oxygen during a bleaching sequence, at a level of materials corresponding to those that are obtained by the conventional chlorine bleach processes.

Bleaching of wood pulps at the present time takes place predominantly with the use of chlorine or chlorine-containing bleaching agents. However, oxygen-containing bleaching agents such as oxygen, ozone or hydrogen peroxide are being used increasingly. This is due to the undesirable pollution of waste water caused by release of chlorinated compounds.

It has been shown that the chlorine requirement for a conventional final bleach can be considerably reduced by the use of oxygen for predelignifications. However, the use of chlorine cannot be avoided completely.

Delignification with just oxygen or hydrogen peroxide produces only limited lignin degradation rates. If very drastic delignification conditions are used in the oxygen step, there is irreversible damage to the wood pulp.

The combined use of oxygen and ozone is necessary for intensification of the delignification. However, ozone is a very reactive and simultaneously nonselective bleaching agent. Thus, side reactions, such as the oxidation of wood pulp, cannot be prevented even with low ozone charge amounts. In this case, the resulting carbonyl groups elevate the sensitivity of wood pulp toward alkaline degradation. The alkaline extraction following the ozone treatment, which takes place in acidic medium, leads to a cleavage of cellulose chains and thus to a reduction of the viscosity and strength of the wood pulp in comparison to materials bleached with the use of chlorine. O. Kordsachia and R. Patt in the journal, Holzforschung 42, 203–209 (1988), report that the reduction of the average polymerization values caused by ozone treatment can be at least partially suppressed by the addition of sodium borohydride. However, this is possible only at low ozone dosages (0.5%) which yield modest brightnesses (86 (ISO)).

SUMMARY OF THE INVENTION

It is an object of the present invention to find a procedure by which, in comparison to materials bleached with the use of chlorine, almost no reduction of the viscosities at low ozone dosages occur. In addition, even at higher concentrations of ozone, only a slight drop in viscosity occurs. Wood pulps are obtained with a brightness of approximately 90 (ISO).

A further object of the present invention is a process for stabilization of the viscosity of wood pulp in association with an ozone or ozone/oxygen treatment. This process is characterized by the fact that the wood pulp is treated with 0.05 to 1 wt.-% formamidinesulfinic acid based on absolutely dry wood pulp. The process occurs at a pH-value of 8 to 12 and at a temperature of 40° to 90° C., preferably 50° to 80° C.

DETAILED DESCRIPTION OF THE INVENTION

Both alkaline- and acidic-produced sulfite wood pulps, as well as craft wood pulps, are suitable as a wood pulp for this process These pulps can be on a pine or hardwood basis.

The ozone or ozone/oxygen treatment is accomplished, according to the state of the art, in an acidic medium. Generally, the ozone concentration is 0.1 to 4% based on absolutely dry wood pulp The formamidinesulfinic acid is used in the alkaline extraction step: Additional equipment expense is not required The stock density of the pulp lies between 5 and 10%, preferably between 8 and 12%.

The normal residence time in this step generally is sufficient to obtain stabilization of the viscosity Additional bleaching steps can then be incorporated.

By means of the process according to the present invention, it is possible to use a chlorine-free bleach to obtain wood pulps that are almost indistinguishable in brightness, viscosity and strength from those obtained by the conventional process (i.e., the process operating with the use of chlorine). Even with high ozone dosages (~3%), the differences are extremely small.

EXAMPLES

The percentage statements are based on absolutely dry wood pulp

1. Spruce sulfite paper pulp (kappa 18.0)

(a) Conventional bleach according to C-E-D-H

| Charged Chemicals: | | stock density | time | temp. |
|---|---|---|---|---|
| C | 4% $Cl_2$ | 3% | 1 h | 25° C. |
| E | 2% NaOH | 10% | 1.5 h | 70° C. |
| D | 1% $ClO_2$ (active chlorine) | 10% | 3 h | 70° C. |
| H | 1% NaOCl | 10% | 3 h | 40° C. |

Results: brightness 90.7 (ISO)
viscosity 12.2 mPa s (b) Chlorine-free bleach according to EOP-Z-E-P

| Charged Chemicals: | | stock density | time | temp. |
|---|---|---|---|---|
| EOP | 1.8% NaOH | | | |
| | 0.75% $H_2O_2$ | 0.3 MPa $O_2$ | | |
| | 1.0% $O_2$ | 10% | 1 h | 70° C. |
| Z | 1.0% $O_3$ | 25% | 0.25 h | 30° C. |
| E | 1.0% NaOH | 10% | 1 h | 50° C. |
| P | 1.0% $H_2O_2$ | | | |
| | 0.7% NaOH | 10% | 3 h | 75° C. |

Results: brightness 90.3 (ISO)
viscosity 8.2 mPa s (c) Chlorine-free bleach according to EOP-Z-E (FAS)-P Charged Chemicals:

EOP
Z as in (b)

| | | stock density | time | temp. |
|---|---|---|---|---|
| E (FAS) | 1% NaOH<br>0.5% FAS | 10% | 1 h | 50° C. |

P as in (b)

Results: brightness 90.5 (ISO),
viscosity: 12.3 mPa s

2. Pine craft pulp (kappa 33.2)

(a) Conventional: CD-E-D-E-D

| | | stock density | time | temp. |
|---|---|---|---|---|
| CD | 7% $Cl_2$/0.7% $ClO_2$ | 3% | 1 h | 25° C. |
| E | 2.8% NaOH | 10% | 1.5 h | 60° C. |
| D | 3% $O_3$ | 10% | 3 h | 65° C. |
| E | 1% NaOH | 10% | 1 h | 65° C. |
| D | 1% $ClO_2$ | 10% | 3 h | 70° C. |

Results: brightness 90.7 (ISO)
viscosity 20.2 mPa s
Strength at 20 SR: tear length 8.8 km
tearing resistance: 9.3 mN $m^2/g$ (b) Chlorine-free bleach according to 0-Z-E-P -continued

| | | stock density | time | temp. |
|---|---|---|---|---|
| | | | 0.5 Mpa $O_2$ | |
| O | 5% NaOH, 0.3% $MgSO_4$ | 10% | 1.5 h | 110° C. |
| Z | 3% $O_3$ | 33% | 25 min | 30° C. |
| E | 1% NaOH | 10% | 1.5 h | 60° C. |
| P | 2% $H_2O_2$, 0.8% NaOH 0.2% $MgSO_4$, 1% water glass | 20% | 2 h | 75° C. |

Results: brightness 89.8 (ISO)
viscosity 12.1 mPa s
Strength at 20 SR: tear length 6.8 km
Tearing resistance: 7.6 mN $m^2/g$ (c) chlorine-free bleach with FAS in the E-step E-step with 0.4% formamidinesulfinic acid
Results: brightness 90.1 (ISO)
viscosity 18.7 mPa s
Strength at 20 SR: tear length 8.8 km
Tearing resistance: 9.2 mN $m^2/g$ 3. Beech sulfite wood pulp (kappa 14.2)

(a) Conventional bleach according to C-E-H-D

| | | stock density | time | temp. |
|---|---|---|---|---|
| C | 4.1% $Cl_2$ | 3% | 1 h | 20° C. |
| E | 1.8% NaOH | 10% | 1.5 h | 65° C. |
| H | 1.5% Na | 10% | 2 h | 40° C. |
| D | 0.7% $ClO_2$ | 10% | 3 h | 65° C. |

Results: brightness 89.1 (ISO)
Strength at 25 SR: tear length 5.4 km
Tear propagation resistance: 132 mNm/m
Viscosity: 12.1 mPa s; kappa: 0.8

(b) Chlorine-free bleaching according to Z-E-P

| | | stock density | time | temp. |
|---|---|---|---|---|
| Z | 1.5% $O_3$ | 35% | 20 min | 20° C. |
| E | 1.8% NaOH | 10% | 1.5 h | 60° C. |
| P | 1.5% $H_2O_2$, 1.1% NaOH | 10% | 2 h | 65° C. |

Results: brightness 88.2 (ISO)
Strength at 25 SR: tear length 4.7 km
Tear propagation resistance: 98 mNm/m
Viscosity: 7.8 mPa s; kappa: 1.1

(c) With FAS in the extraction step

-continued

Z as in (b)
E as in (b)
0.5% formamidinesulfinic acid in addition
P as in (b)
Results: brightness 88.7 (ISO)
Strength at 25 SR: tear length 5.3 km
Tear propagation resistance: 130 mNm/m
Viscosity: 11.2 mPa s
Kappa value: 1.1

The letter symbols used herein; (e.g EOP, etc ) have well known meaning in the art.

Further variations and modifications of the foregoing invention will be apparent to those skilled in the art and are intended to be encompassed by the claims appended hereto.

What is claimed is:

1. A process for stabilization of the viscosity of wood pulps that have been treated with ozone of ozone and oxygen but not with chlorine during a bleaching sequence comprising treating the wood pulp with formamidinesulfinic acid during an alkaline extraction step.

2. A process according to claim 1 wherein the reaction temperature of said alkaline extraction step is 40° to 90° C.

3. A process according to claim 2 wherein the said reaction temperature is 50° to 80° C.

4. A process according to claim 1 wherein the reaction pH of said alkaline extraction step is 8 to 12.

5. A process according to claim wherein the said formamidinesulfinic acid is present at 0.05 to 1 wt.-% based on absolutely dry wood pulp.

6. A process for stabilization of wood pulps that have been treated with ozone or ozone and oxygen but not with chlorine during a bleaching sequence comprising treating the wood pulp at 40° to 90° C. at a pH-value of 8 to 12 with 0.05 to 1 wt.-% formamidinesulfinic acid based on absolutely dry wood pulp.

* * * * *